US010149044B2

(12) United States Patent
Behles et al.

(10) Patent No.: US 10,149,044 B2
(45) Date of Patent: Dec. 4, 2018

(54) VIBRATION DAMPING STRUCTURE FOR AUDIO DEVICE

(71) Applicant: Nokia Corporation, Espoo (FI)

(72) Inventors: Thorsten Behles, Kangasala (FI); Pasi Tuomo Antero Kemppinen, Tampere (FI); Mikko Tapio Jyrkinen, Tampere (FI)

(73) Assignee: Nokia Technologies Oy, Espoo (FI)

( * ) Notice: Subject to any disclaimer, the term of this patent is extended or adjusted under 35 U.S.C. 154(b) by 109 days.

(21) Appl. No.: 14/336,164

(22) Filed: Jul. 21, 2014

(65) Prior Publication Data

US 2016/0021444 A1 Jan. 21, 2016

(51) Int. Cl.
*H04R 1/28* (2006.01)

(52) U.S. Cl.
CPC ..... *H04R 1/288* (2013.01); *H04R 2499/11* (2013.01)

(58) Field of Classification Search
CPC ..... H04R 1/2803
See application file for complete search history.

(56) References Cited

U.S. PATENT DOCUMENTS 3,386,527 A * 6/1968 Daubert ..... E04B 1/82 181/208
3,457,375 A * 7/1969 Haggerty ..... H04R 25/456 381/322
5,719,359 A * 2/1998 Wolf ..... G10K 11/172 181/200
6,635,210 B2 * 10/2003 Nilsson ..... B29C 45/14 264/155
6,671,171 B1 * 12/2003 Homer ..... G06F 1/1616 361/600
6,731,764 B2 * 5/2004 Asada ..... H04R 5/02 381/152
6,826,285 B2 * 11/2004 Azima ..... H04R 7/045 381/152
7,174,025 B2 * 2/2007 Azima ..... H04R 7/045 381/152
2001/0017924 A1 8/2001 Azima et al. ..... 381/165
2001/0028716 A1 10/2001 Hill et al. ..... 381/58
2002/0118847 A1 8/2002 Kam ..... 381/111
2003/0083424 A1 * 5/2003 Duck ..... C08J 3/18 524/523

(Continued)

FOREIGN PATENT DOCUMENTS

WO WO-2012/025783 A1 3/2012
WO WO-2012/052803 A1 4/2012

(Continued)

*Primary Examiner* — Matthew Eason
*Assistant Examiner* — Taunya McCarty
(74) *Attorney, Agent, or Firm* — Harrington & Smith

(57) ABSTRACT

An apparatus comprises a movable section for sound generation; at least one actuator configured to actuate the movable section, the actuator being in communication with electronic circuitry and configured to generate an acoustic signal substantially from the movable section when the at least one actuator is driven by an audio signal; and a back cover coupled to the movable section and configured to limit the generation of sound from the back cover by attenuating vibrations that are caused when the movable section is actuated by the at least one actuator. The movable section and the at least one actuator define a panel speaker.

18 Claims, 14 Drawing Sheets

(56) References Cited

U.S. PATENT DOCUMENTS

| | | | | |
|---|---|---|---|---|
| 2004/0240687 | A1* | 12/2004 | Graetz | H04R 7/045 381/152 |
| 2005/0130716 | A1* | 6/2005 | Shin | H04M 1/035 455/575.1 |
| 2006/0181522 | A1 | 8/2006 | Nishimura et al. | 345/177 |
| 2006/0270459 | A1* | 11/2006 | Lee | H04M 1/03 455/565 |
| 2007/0202917 | A1* | 8/2007 | Phelps | H04R 7/045 455/556.1 |
| 2011/0187245 | A1* | 8/2011 | Pakula | G06F 1/1626 312/223.1 |
| 2013/0114840 | A1* | 5/2013 | Shin | H04M 1/035 381/332 |
| 2013/0156233 | A1* | 6/2013 | Joo | H04M 1/0266 381/151 |
| 2014/0192489 | A1* | 7/2014 | Rothkopf | H01M 2/1016 361/749 |
| 2014/0228081 | A1* | 8/2014 | Chang | H04B 1/3888 455/575.8 |
| 2014/0241558 | A1* | 8/2014 | Yliaho | H04R 5/02 381/333 |
| 2014/0315605 | A1* | 10/2014 | Cho | H04M 1/035 455/575.1 |

FOREIGN PATENT DOCUMENTS

| | | | |
|---|---|---|---|
| WO | WO-2012090031 | A1 | 7/2012 |
| WO | WO-2012/111348 | A1 | 8/2012 |

* cited by examiner

VIBRATION DAMPING STRUCTURE FOR AUDIO DEVICE

BACKGROUND

Technical Field

The exemplary and non-limiting embodiments disclosed herein relate generally to audio devices and, more particularly, to mobile audio devices having panel speakers that incorporate structures for damping vibrations to improve acoustic performance.

Brief Description of Prior Developments

Mobile devices such as phones generally include earpieces that employ conventional speaker technology to enable a user to listen to an audio downlink signal. In a phone employing conventional speaker technology, audio signals are emitted from a device located internally in the phone, through a hole, and directly into the user's ear.

Some mobile phone manufacturers produce phones that employ panel speakers behind a front display through which the user interacts with the phone. The phones that incorporate these panel speakers generally include polycarbonate back covers that are acoustically coupled to internal portions of the phones, which cause audio signal leakage through the back covers, thereby compromising user privacy.

SUMMARY

The following summary is merely intended to be exemplary. The summary is not intended to limit the scope of the claims.

In accordance with one aspect, an apparatus includes a movable section for sound generation; at least one actuator configured to actuate the movable section, the actuator being in communication with electronic circuitry and configured to generate an acoustic signal substantially from the movable section when the at least one actuator is driven by an audio signal; and a back cover coupled to the movable section and configured to limit the generation of sound from the back cover by attenuating vibrations that are caused when the movable section is actuated by the at least one actuator. The movable section and the at least one actuator define a panel speaker.

In accordance with another aspect, a method comprises inputting data into an electronic device having a first portion and a second portion; causing the operation of a controller having a memory and a processor; communicating with a means for receiving a downlink audio signal; and providing the downlink audio signal through the first portion and limiting transmission of the downlink audio signal through the second portion by attenuating vibrations from the audio signal.

In accordance with another aspect, a non-transitory computer readable storage medium comprises one or more sequences of one or more instructions which, when executed by one or more processors of an apparatus, cause the apparatus to at least: communicate with a means for receiving a downlink audio signal; and provide the downlink audio signal through the first portion while limiting transmission of the downlink audio signal through the second portion by attenuating vibrations.

In accordance with another aspect, an apparatus comprises means for generating a sound via a movable section; means for actuating the movable section via electronic circuitry; and means for limiting the generation of the sound when the movable section is actuated. The means for generating the sound and the means for actuating the movable section define a speaker.

BRIEF DESCRIPTION OF THE DRAWINGS

The foregoing aspects and other features are explained in the following description, taken in connection with the accompanying drawings, wherein.

DETAILED DESCRIPTION OF EMBODIMENT

Figure 1:
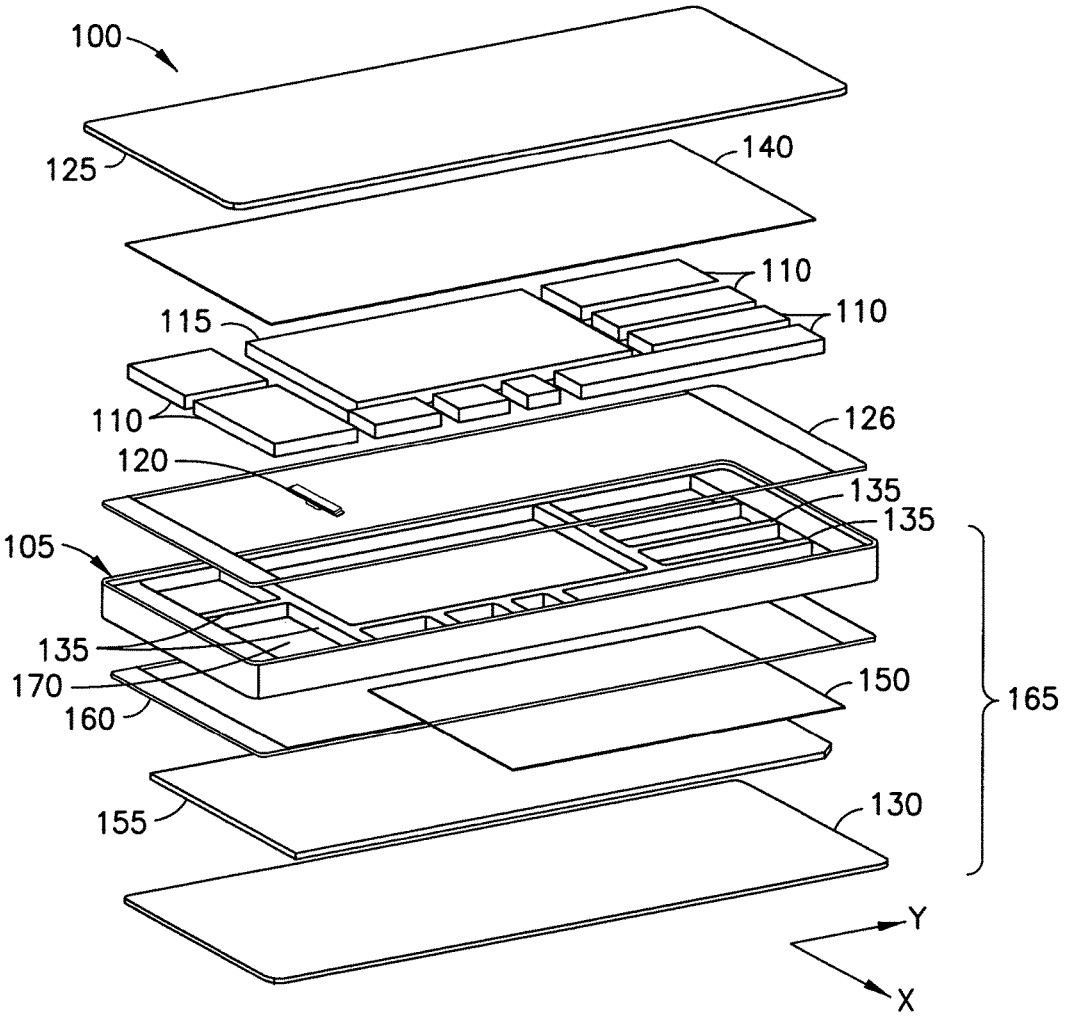
FIG. 1 is an exploded view of one exemplary embodiment of a mobile device incorporating a panel speaker.

The exemplary devices disclosed herein are directed to electronic devices (such as mobile devices including, but not limited to, phones, cameras, video cameras, gaming units, navigation units, and tablets) employing earpieces having panel speakers that deliver signals as audio output or audio playback to a user. Although any type of electronic device is within the scope of the disclosed exemplary embodiments, the devices are hereinafter referred to as being mobile phones or phones. In a mobile phone employing a panel speaker, the user can hold the phone such that the earpiece is positioned on or at least adjacent to the user's ear, thereby allowing the user to listen to the audio signal.

When panel speakers are used in mobile phones, the user becomes part of the acoustic system by way of placement of the ear on a vibrating panel. The vibrating panel comprises a display, which is held in place by a frame attached to a chassis on which electronic components associated with the mobile phone are mounted. Ribs are employed in the chassis to stiffen the chassis construction and to create wide band sound outputs as compared to traditional earpiece speaker components and other panel speakers. A back cover is coupled to the chassis. In doing so, the system defined by the mechanics of the phone (or any other electronic device) can be designed so that suitable acoustic output (downlink audio signal performance) is provided through the display to the user and such that emission of audio signals through the back cover to the ambient environment is limited.

In the exemplary embodiments described herein, the panel speakers emit sufficient sound pressure at lower frequencies (e.g., below about 1 kilo Hertz (kHz)) to provide suitable audio signals as output. At lower frequencies, which provide the desired wide band frequency responses, the suspension of a movable section (such as a display screen, a display window, a display module, a device cover, or the like and which is hereinafter referred to generally as "display") on a chassis is very stiff. This movable section may provide one avenue (which may not be the only avenue) by which sound may be transmitted. Such stiffness is generally desirable because if the user notices that the display moves, for example due to a flexible suspension, the user's general perception is that the device is defective. However, in the exemplary embodiments of the devices disclosed herein, a flexible suspension may be employed to provide sufficient output audio signals at frequencies of about and less than 1 kHz, the frequency responses being smooth with minimum amounts of peaks and valleys. Furthermore, the exemplary embodiments of the devices disclosed herein are built such that errant audio signal leakage through the back cover is limited even though a relatively large portion of the surface of the device is vibrated to operate as the speaker. Leakage of audio signal is kept to a minimum in order to avoid the signal being audible to people in close proximity to the user, which thereby allows the user to maintain privacy, thereby avoiding "privacy leakage."

Referring to the Figures, exemplary embodiments of mobile phones having panel speakers are shown. Although the features of the mobile phones will be described with reference to the example embodiments shown in the drawings, it should be understood that features can be embodied in many alternate forms. In addition, any suitable size, shape, or type of elements or materials could be used.

Referring to FIG. 1, one exemplary embodiment of a mobile phone having a panel speaker is designated generally at 100 and is hereinafter referred to as "phone 100." Phone 100 comprises a first portion such as a chassis 105 defined by a frame having a front face over which a shield plate 170 extends. The chassis 105 includes one or more walls or ribs 135 that define compartments in which electronic components 110 (e.g., a printed wiring board, a controller, processors, memory, a battery 115) are mounted. At least a portion of the electronic components 110 comprises circuitry capable of carrying out operation of the phone 100. A piezoelectric actuator 120 is also mounted on the chassis 105.

A front window 130 is positioned on a front face of the chassis 105. An echo cancellation tape 150 and a display 155 (e.g., an organic light emitting diode (OLED) or a flexible OLED (FOLED) through which the user can interact with the phone 100) are positioned on the chassis 105 between the shield plate 170 and the front window 130. A flexible suspension 160 (which may be in the form of a tape) is positioned under peripheral edges of the display 155. The chassis 105 with the ribs 135, in conjunction with at least the display 155 and the front window 130, operates as a panel speaker 165.

A second portion such as a back cover 125 is coupled to a back face of the chassis 105 and retained thereon at least in some embodiments via a back cover tape 126 such as a high lossy tape or high lossy foam tape. A damping layer 140 is positioned between the electronic components 110 and the back cover 125 and is coupled to the back cover 125.

Figure 2:
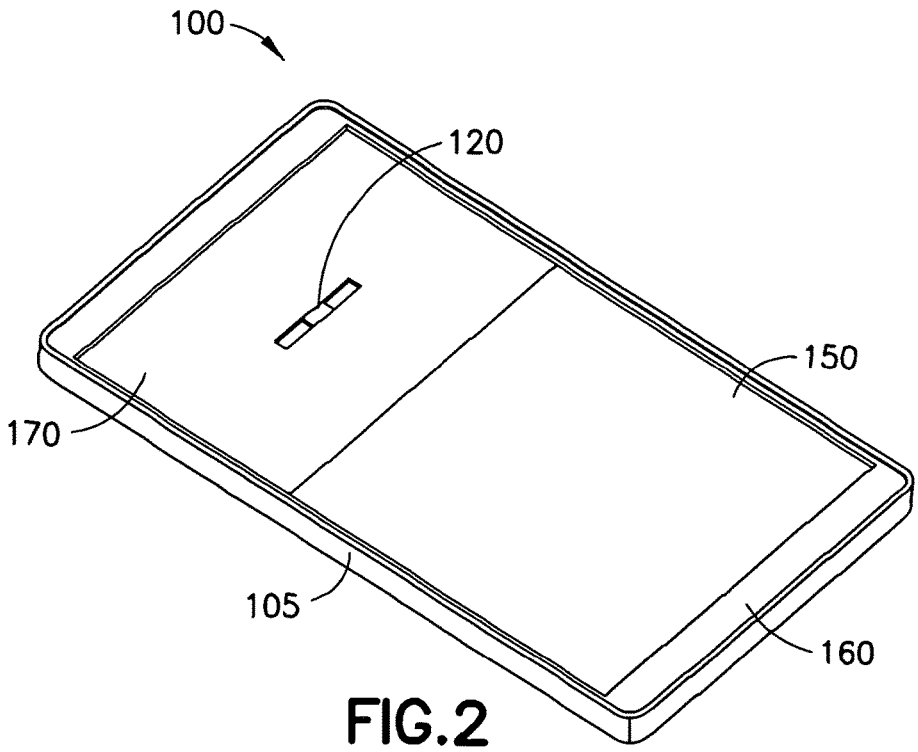
FIG. 2 is a perspective view of the front of the mobile device of FIG. 1.

Referring to FIG. 2, the suspension 160 is disposed around the peripheral edges of the display 155 (not shown in FIG. 2) on an inside-facing surface of the display 155. The echo cancellation tape 150 is positioned on the shield plate 170 and within the periphery of the suspension 160 between the piezoelectric actuator 120 and a lower end of the phone 100. As shown, the echo cancellation tape 150 extends substantially over the entire width of the phone 100. The piezoelectric actuator 120 is mounted to the shield plate 170.

Figure 3:
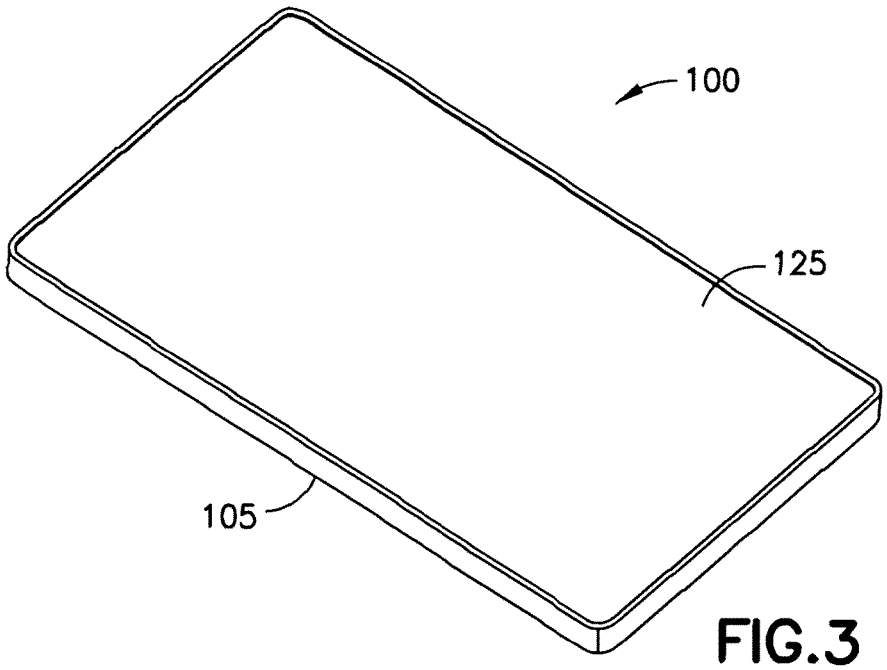
FIG. 3 is a perspective view of the back of the mobile device of FIG. 1.

Referring to FIG. 3, the back cover 125 is positioned within edges of the frame defining the chassis 105. The back cover 125 comprises a polymer or plastic material such as polycarbonate. Other materials from which the back cover 125 may be fabricated include, but are not limited to, glass, ceramic, metal, composite materials such as carbon fiber composites, and the like.

Figure 4:
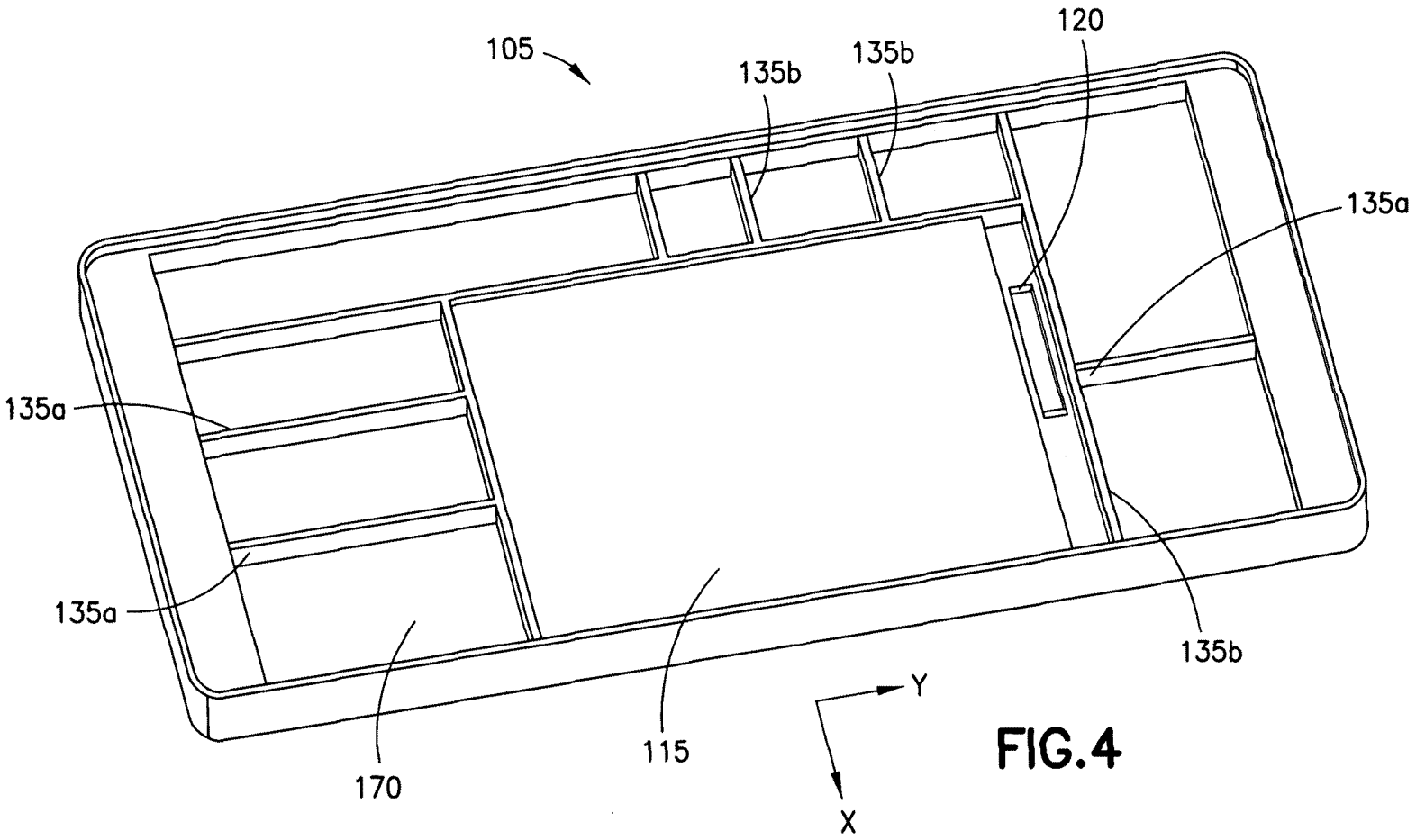
FIG. 4 is a perspective view of the back of the chassis of the mobile device.

Referring now to FIG. 4, the frame defining the chassis 105 includes the ribs 135 extending across the frame and the shield plate 170 defining compartments in which the electronic components 110 may be mounted. The ribs 135 contribute to the stiffening and rigidity of the chassis 105 and the overall construction of the phone 100. More specifically, one or more ribs 135*a* extend in the X direction and one or more ribs 135*b* extend in the Y direction. The ribs 135 are generally about 1 millimeter (mm) wide although they may be about 0.5 mm wide to about 3 mm wide. The chassis 105, ribs 135, and shield plate 170 are fabricated from aluminum, aluminum alloy, stainless steel, magnesium, magnesium alloy, titanium, titanium alloy, ceramic, or similar materials.

The positioning of the ribs 135 in the chassis 105 directs audio signals within the body of the phone 100, thereby contributing to the flattening of the frequency response from the panel speaker 165, which in turn facilitates the low frequency sound reproduction. The ribs 135 also route force vibrations within the chassis 105 to help minimize sound emitted through the back cover 125 of the phone 100. The stiffness of the construction of the phone 100 based on the positioning of the ribs 135 and the material from which the chassis 105 is fabricated in combination with echo cancellation (e.g., from the echo cancellation tape 150) is also beneficial for addressing challenges with regard to uplink echo.

The shield plate 170 includes an opening for mounting of the piezoelectric actuator 120. The shield plate 170 may be coupled to or integral with portions of the frame defined by the chassis 105 and/or the ribs 135.

Figure 5:
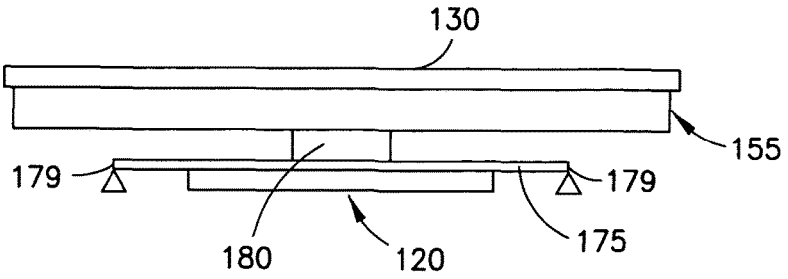
FIG. 5 is a schematic representation of a piezoelectric actuator mounted in the mobile device.

Referring now to FIG. 5, the piezoelectric actuator 120 is coupled to opposing ends 179 of a metal plate 175 fixed across an opening in the shield plate 170. A connecting pad 180 fabricated from, for example, firm foam is positioned between the metal plate 175 and the display 155. During operation, the piezoelectric actuator 120 urges the display 155 away from the chassis 105 and against the front window 130. Due to the positioning of the piezoelectric actuator 120 in the shield plate 170, the impulse from the piezoelectric actuator 120 is directed toward the front of the phone 100. The piezoelectric actuator 120 is configured to generate a force of about 0.2 Newtons (N) to about 1 N, with a substantial portion of such force being directed into the display 155 to make the display 155 move or vibrate (which is beneficial for low frequency sound reproduction), thereby transferring the audio signal output through the display 155 and through the front window 130 to the user. The piezoelectric actuator 120 may be a uni-morph piezoelectric actuator element. The exemplary devices described herein are not limited to uni-morph piezoelectric actuators, as any type of piezoelectric actuator may be employed (e.g., discs, bender-types, or direct-drive ceramic-types (a piezoelectric bender structurally supported at the ends thereof with a connecting piece between the two ends, the connecting piece configured to route force from the piezoelectric bender into the panel)). Additionally, dynamic voltage-current motors, unbalanced or balanced armatures, or magnetorestrictive drivers could be used.

Figure 6:
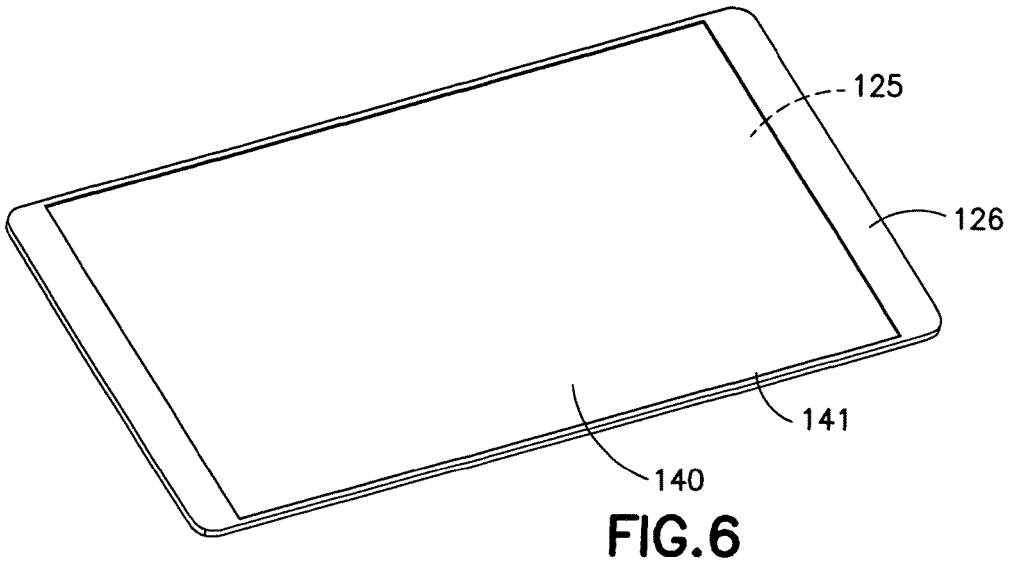
FIG. 6 is a perspective view of an inside surface of a back cover of the mobile device.

Referring to FIG. 6, the back cover 125 includes the back cover tape 126 disposed around a peripheral edge of the back cover 125 on an inside-facing surface of the back cover 125. The damping layer 140 is coupled to the inside-facing surface of the back cover 125 via a layer of epoxy adhesive 141 or pressure sensitive adhesive (PSA) tape disposed on at least a portion of the inside-facing surface.

The damping layer 140 is an epoxy material such as an elastomer substrate material incorporating an epoxide. The epoxide may be absorbed in the elastomer. The epoxy material is formulated and configured to have calculated effects on the transmission of the audio signals, e.g., the damping of certain frequencies of sound. The epoxy material is spread as a thin layer over the inner surface of the back cover 125 to reduce the sound pressure level (SPL) at the back surface of the phone 100. A sound absorption coefficient (attenuation coefficient) indicates how much sound is absorbed by the epoxy material. The sound absorption coefficient of the epoxy material is preferably as great as possible to quickly absorb (attenuate) and therefore weaken sound waves as they pass from the internal portion of the phone 100 to the back cover 125. Elastomer substrate materials for use in the epoxy material of the damping layer 140 include, but are not limited to, synthetic and/or natural rubber-modified resins. Epoxides for absorption in the elastomer substrate materials include any suitable epoxide material.

Figure 7:
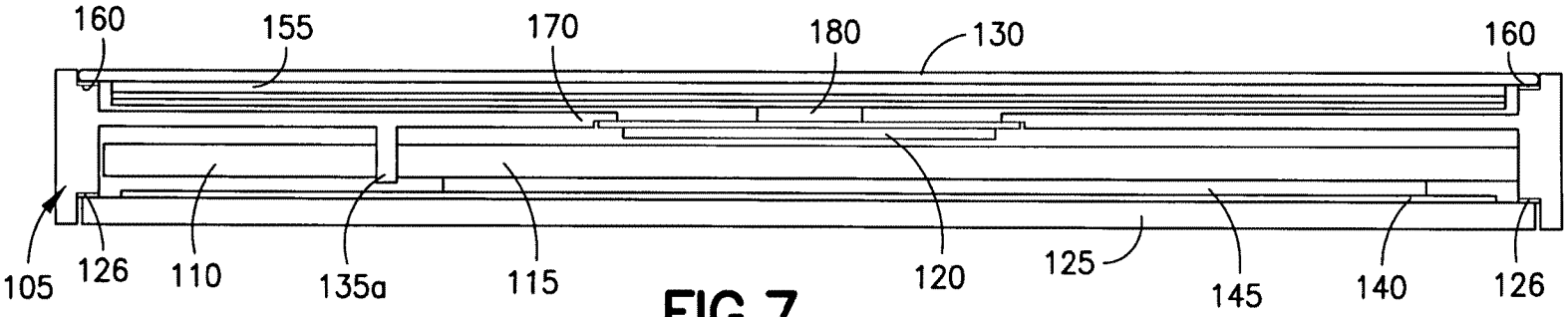
FIG. 7 is a sectional view of the mobile device along the Y axis.
Figure 8:
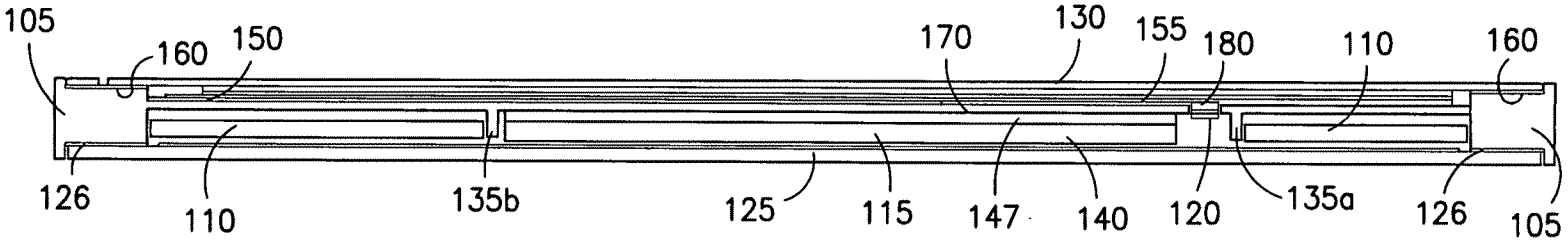
FIG. 8 is a sectional view of the mobile device along the X axis.

Referring now to FIGS. 7 and 8, the chassis 105 includes rabbeted edges along both the front side and back side of the frame defining the chassis 105. The suspension 160 fits into a forward-facing surface of the rabbeted edge on the front side of the chassis 105, and the front window 130 is fixed onto the suspension 160. The front window 130 retains the display 155 and the connecting pad 180 against the piezoelectric actuator 120. The back cover tape 126 fits into a rearward-facing surface of the rabbeted edge on the back side of the chassis 105, and the back cover 125 is fixed to the back cover tape 126. The back cover 125 assists in retaining the battery 115 and the electronic components 110 against the rearward-facing surface of the shield plate 170 and between the ribs 135 (ribs 135*a* extending in the X direction, as shown in FIG. 7, and ribs 135*b* extending in the Y direction, as shown in FIG. 8). The battery 115 may be coupled to the shield plate 170 using lossy tape such as a pressure sensitive adhesive (PSA) tape 147 or the like. Battery-swelling compensation foam 145 may be positioned between the damping layer 140 and the battery 115 (FIG. 7). Because the back cover 125 is decoupled from the chassis 105, vibration created by the piezoelectric actuator 120 is inhibited from spreading into the back cover 125.

Figure 9:
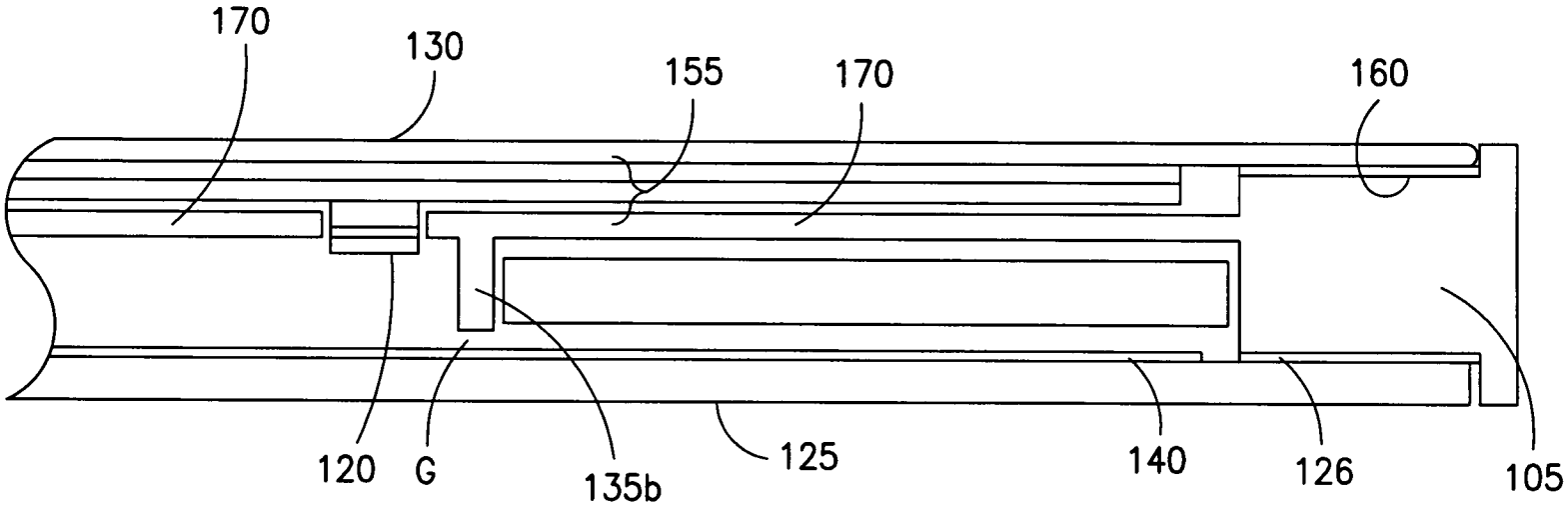
FIG. 9 is a partial sectional view of the mobile device showing a gap between the rib and a damping layer on the back cover.

Referring to FIG. 9, the ribs 135 (rib 135*b* in FIG. 9) terminate short of the damping layer 140 to define a gap G between the ribs 135 and the damping layer 140. Because of this gap G, the overlapping and amplifying of resonant modes of the back cover 125 and the chassis 105 are avoided. The height of the ribs 135 should be as great as possible without touching the back cover 125, thereby defining the gap G. The rib height can also be adjusted (and may be variable throughout the phone 100) to alter the qualities and/or volume of audio signal output. For example, defining a space between the top surfaces of the ribs 135 and the back cover 125 allows the audio signal output to be minimized with regard to errant audio signals, which in turn allows the user to maintain at least some privacy. In an exemplary embodiment of the phone 100, the height of the ribs 135 is about 3 mm, although the height may be about 0.1 mm to about 13 mm (e.g., the full thickness of the phone 100. The ribs 135 (as well as the shield plate 170) may also vary in thickness or include recesses to affect the stiffness of the chassis 105 and to alter the qualities and/or volume of audio signal output.

Referring now to all of FIGS. 1-9, the epoxy material used as the damping layer 140 operates as a means for inhibiting the transmission of sound from the phone 100. In some exemplary embodiments, the epoxy material may be added between the chassis 105 and the back cover 125 (e.g., along the surfaces defining the rabbeted edges along the back side of the frame of the chassis 105, either in place of or in addition to the back cover tape 126.

In some exemplary embodiments, the epoxy material may be used directly in the construction of the back cover 125 to form a unibody epoxy composite cover. For example, the polycarbonate (or other) material of the back cover 125 may be molded or co-molded with the epoxy material.

In another example, the epoxy material may be disposed in layers coupled together to form a back cover 125. For example, several flat layers of different materials such as polycarbonate, carbon fiber, or glass fiber can be joined and molded together (e.g., baked at high temperature) to form the back cover 125. Epoxy material can be further added to the construction to serve as a noise reduction layer.

Furthermore, in another embodiment of the back cover 125 having a metal body construction, an outer portion of the back cover 125 may be metal, and an inner portion may be polycarbonate (or other polymer or glass) co-molded thereto. A layer of the epoxy material can be disposed between the outer portion and the inner portion co-molded to the outer portion. In other exemplary embodiments, the epoxy material may be co-molded as well onto the metal body. In still other exemplary embodiments, the epoxy material can be formed as solid plates and glued onto the metal body, after which a polycarbonate insert can be co-molded onto the metal and epoxy cover.

Figure 10:
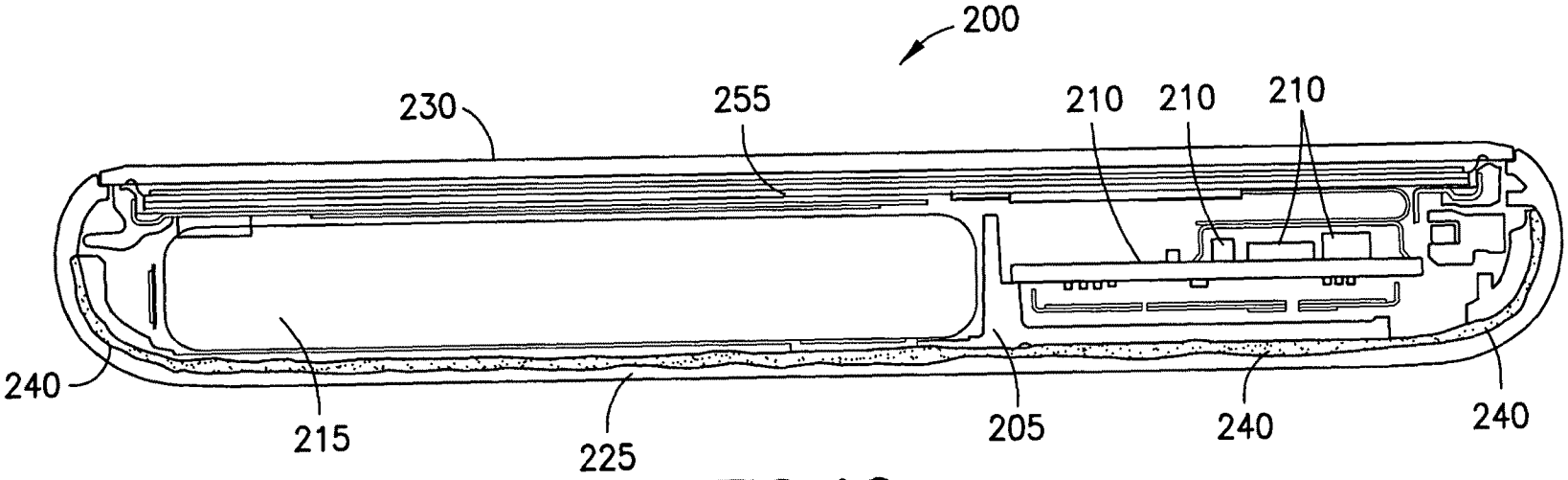
FIG. 10 is a sectional view of another exemplary embodiment of a mobile device.

Referring to FIG. 10, another exemplary embodiment of a mobile phone having a panel speaker is designated generally at 200 and is hereinafter referred to as "phone 200." Phone 200 comprises a chassis 205 and a plurality of electronic components 210 (e.g., a printed wiring board, a controller, processors, memory, and the like) including a battery 215 as well as an actuator. A back cover 225 is coupled directly to a front cover 230 (which retains a display 255 against the actuator) and further to the chassis 205 via an epoxy layer. The epoxy layer operates as a damping layer 240 to absorb and weaken sound waves as they pass from the internal portion of the phone 200 to the back cover 225.

Figure 11:
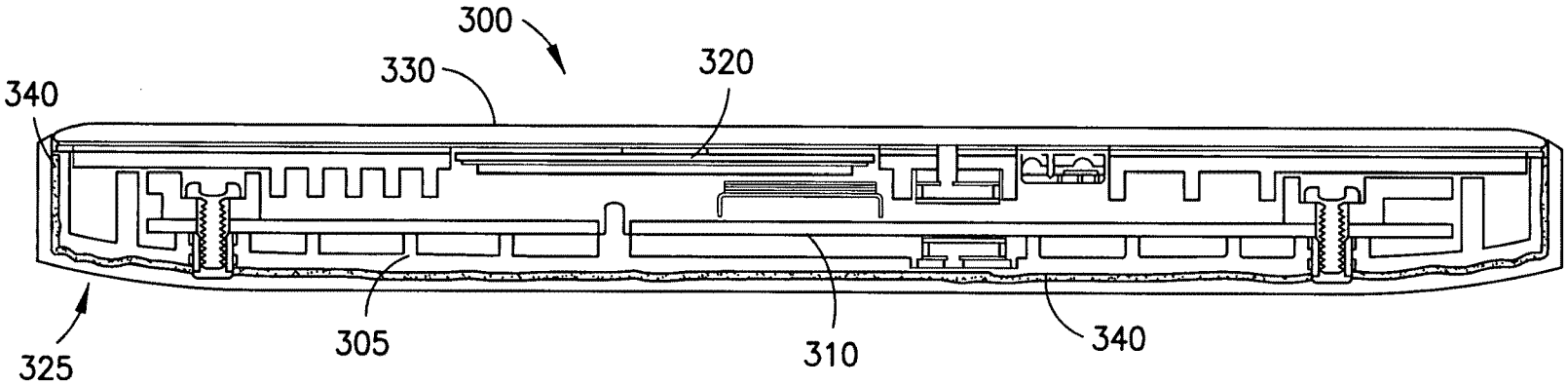
FIG. 11 is a sectional view of another exemplary embodiment of a mobile device.

Referring now to FIG. 11, another exemplary embodiment of a mobile phone having a panel speaker is designated generally at 300 and is hereinafter referred to as "phone 300." Phone 300 comprises a chassis 305, a front cover 330 on the chassis 305, and a plurality of electronic components 310 (e.g., a printed wiring board, a controller, processors, memory) including a battery 315 as well as an actuator 320 on the chassis 305. A back cover 325 comprising metal is coupled to the chassis 305 via an epoxy layer that operates as a damping layer 340 to absorb and weaken sound waves as they pass from the internal portion of the phone 300 to the metal back cover 325.

Figure 12:
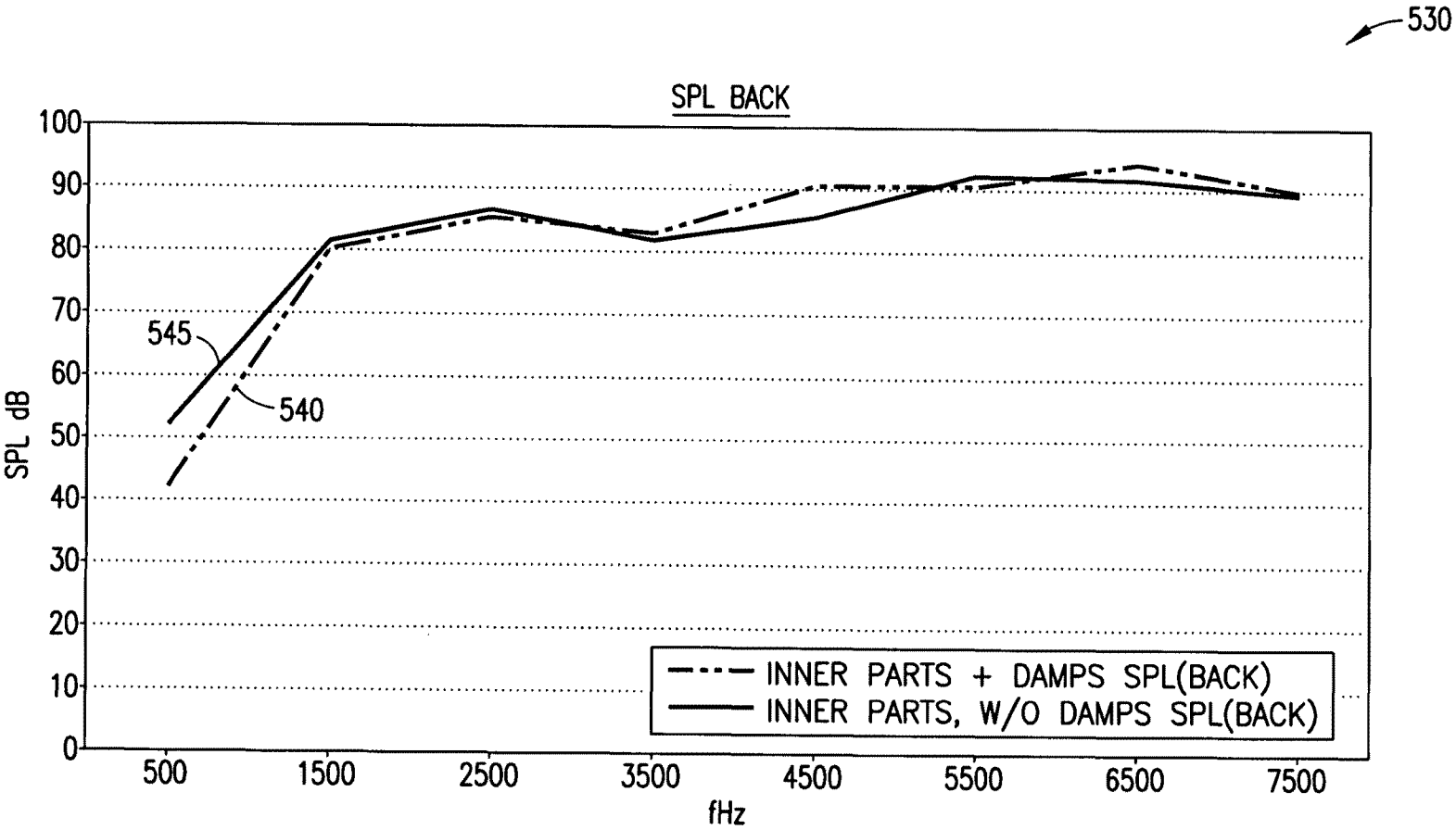
FIG. 12 is a graphical representation of sound pressure levels of a mobile device incorporating damping as compared to a mobile device without damping.

Referring now to FIG. 12, a comparison of sound pressure levels (SPL) of a phone 100 incorporating the back cover 125 with a damping layer 140 (e.g., an epoxy material) held by vibration damping tape (line 540) and a phone without damping (line 545) is shown in graph 530. At frequencies below about 1500 Hz, the use of such damping as indicated by line 540 clearly shows a lower SPL than line 545, which means less privacy leakage occurs with damping. Depending upon the material selected for the damping layer 140, privacy leakage may be further reduced. Epoxy materials can be selected such that at certain frequencies the acoustic damping coefficient is higher, thereby allowing for the attenuation of audio signal output between about 1500 Hz and 4000 Hz.

Still referring to graph 530, the reduction in SPL below about 1000 Hz emitted by the back cover 125 due to the use of damping is also beneficial in the sense that the back cover 125 is subject to less vibration. Frequencies less than about 500 Hz can be easily sensed by the user as haptic feedback, which may or may not be desirable depending upon the type of device being used. Reduction in vibration less than 1000 Hz (and particularly less than 500 Hz) is therefore preferable for the user. Variation in frequency between high and low frequencies, however, may cause other mechanical elements of the phone 100 to resonate.

Figure 13:
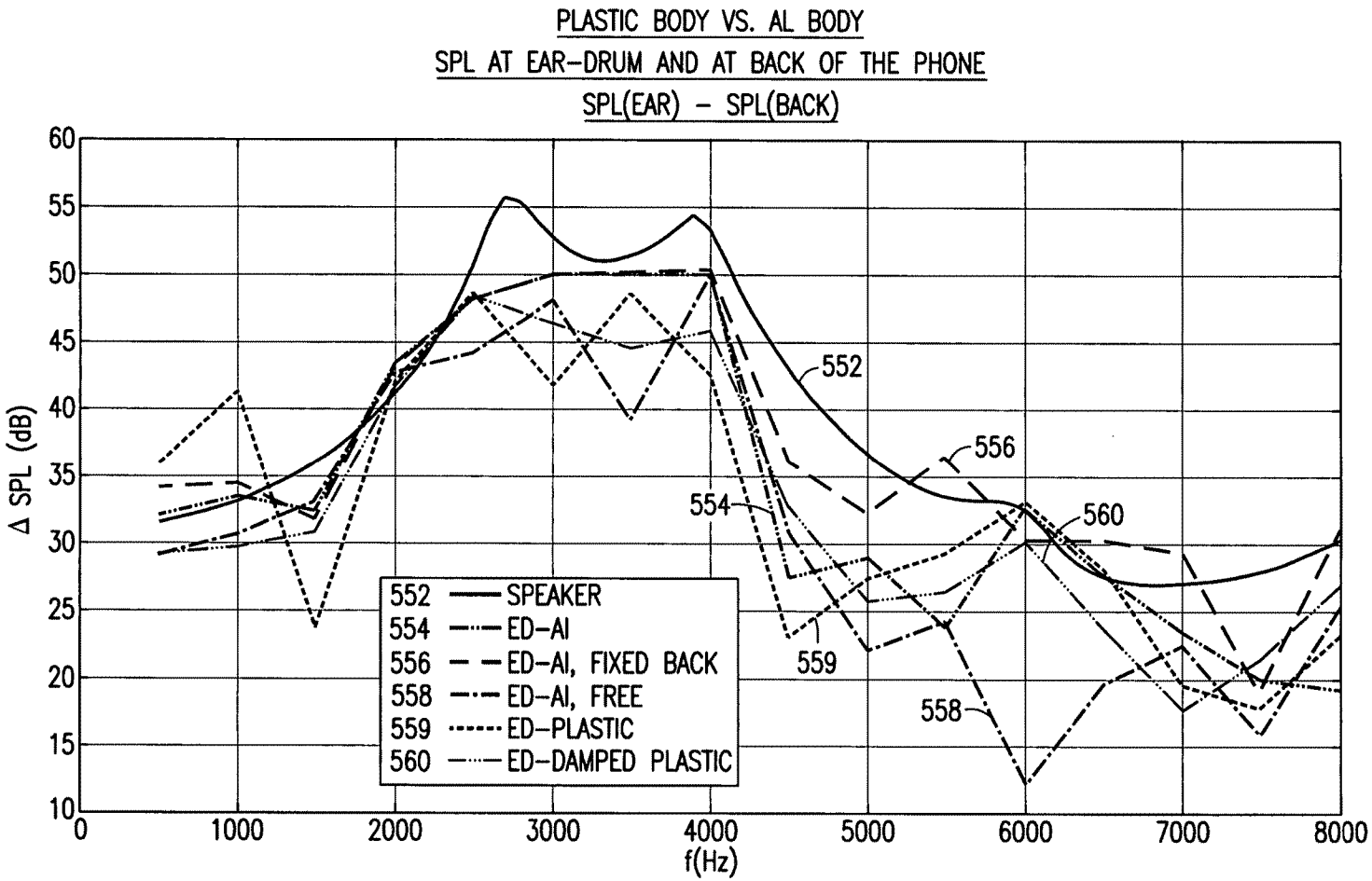
FIG. 13 is a graphical representation of sound pressure levels for mobile devices having aluminum bodies and mobile devices having plastic bodies.

Referring to FIG. 13, SPLs of phones having plastic bodies and phones having aluminum bodies are shown in graph 550. Graph 550 illustrates the differences in SPL with regard to directivity between the fronts of various phones versus the backs of various phones. Line 552 shows a response of a normal speaker having a high sensitivity. Line 554, line 556, and line 558 show responses for phones having aluminum bodies. Lines 556 and 558 show responses when the phones thereof are held in a testing jig. Line 560 and line 559 show responses for phones having plastic bodies.

Based on graph 550, the directivity of aluminum body phones is preferred over plastic body phones because a smoother response frequency is achieved. The main reason for this is due to the higher stiffness of the aluminum bodies. It should be noted that none of the phones tested and shown in graph 550 utilized stiffening ribs or echo cancellation tape. The phones with plastic bodies show strong frequency dips and peaks as compared to the phones with aluminum bodies. Aluminum body phones are preferred over plastic body phones with regard to limiting privacy leakage.

Figure 14:
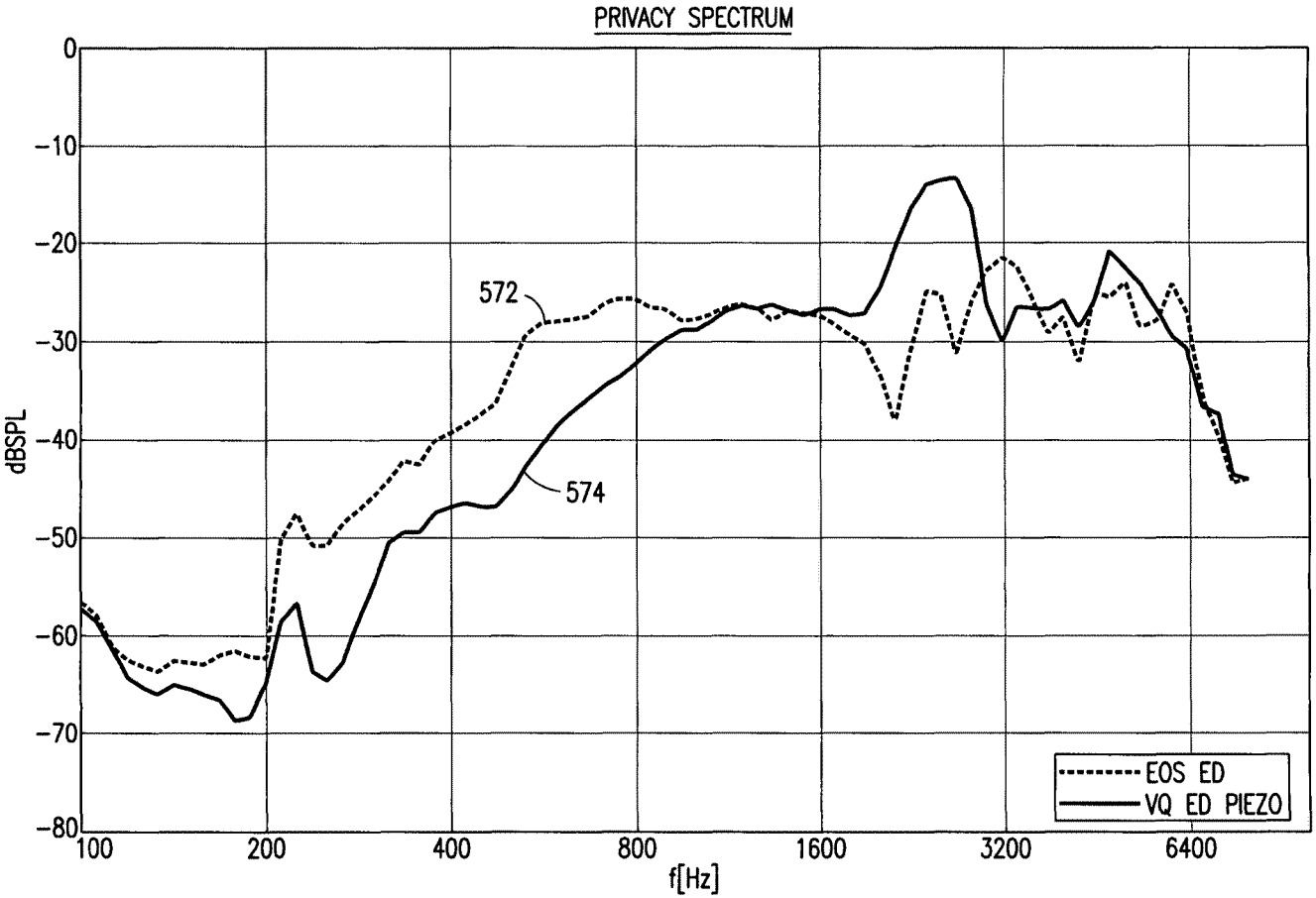
FIG. 14 is a graphical representation of privacy leakage of mobile devices having plastic bodies as compared to mobile devices having aluminum bodies.

Referring now to FIG. 14, graph 570 shows a privacy leakage spectrum difference between a phone having a plastic body (line 572) and a phone having a metal body (line 574). The phone illustrated by line 574 shows performance benefits at frequencies under about 1000 Hz. Upon enhanced modal analysis in the design phase of the metal body phone, advantages realized by stiff metal construction can be further improved. Between about 1600 Hz and about 3600 Hz, however, the metal body construction of the phone provides a response that is louder than that of the plastic body phone. This can be addressed by providing the damping layer 140 on the metal body phone.

Figure 15:
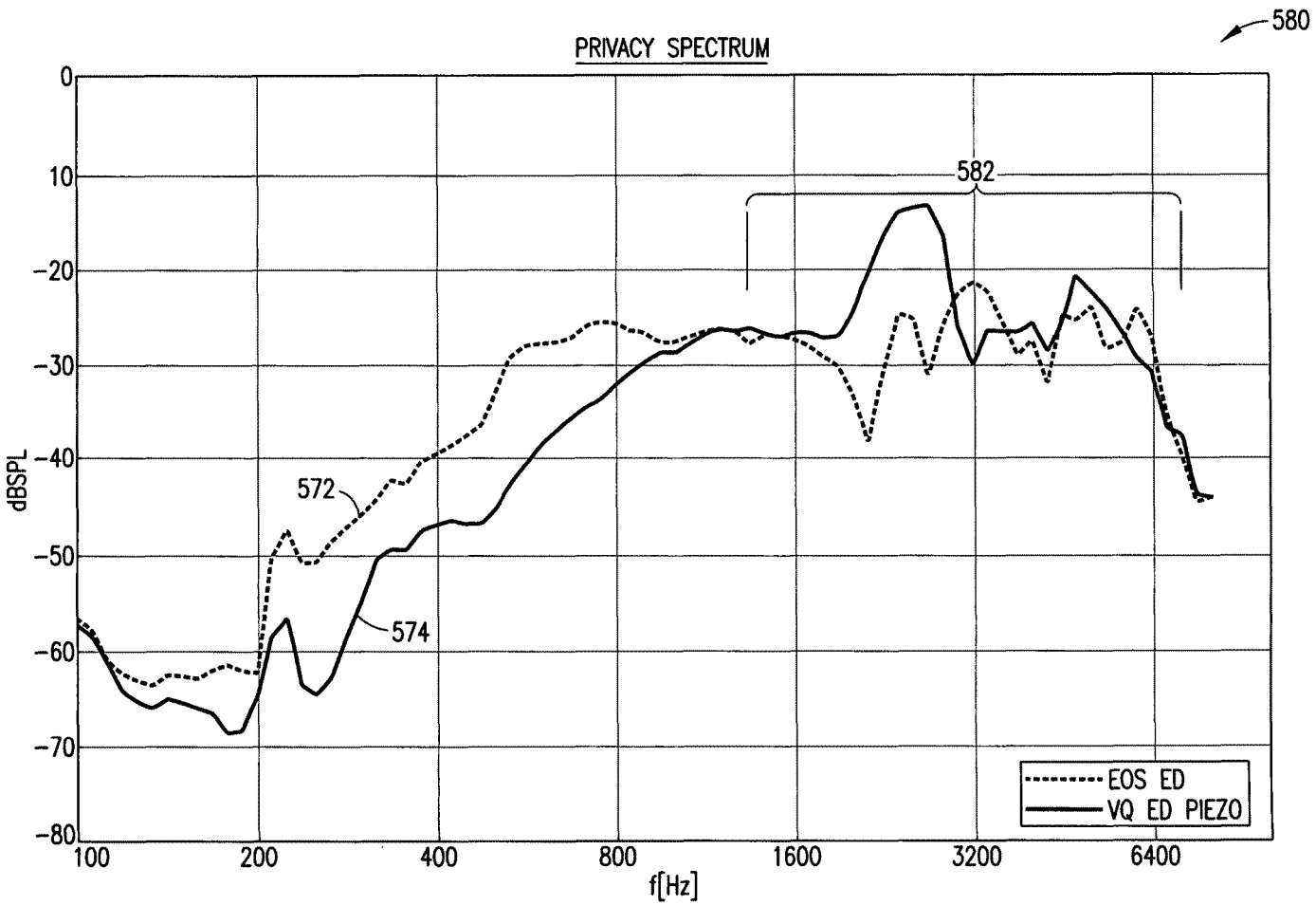
FIG. 15 is a graphical representation of the privacy leakage of FIG. 14 showing a frequency spectrum over which an epoxy material damping layer may be utilized.

Referring now to FIG. 15, graph 580 shows a frequency spectrum 582 (about 1500 Hz to about 4000 Hz) over which privacy leakage should be suppressed using the epoxy damping layer 140. Such epoxy material should be selected to attenuate frequencies over the frequency spectrum 582 in a phone having a metal body with a plastic cover. If a metal body cannot be selected and a plastic body is employed, privacy leakage at frequencies below about 1000 Hz (see line 572) can be reduced by making the back cover 125 as stiff as possible (e.g., by adhering one or more metal ribs to the back cover 125). The epoxy material can be selected such that specific frequencies can be attenuated to address privacy leakage through the back cover 125.

Figure 16:
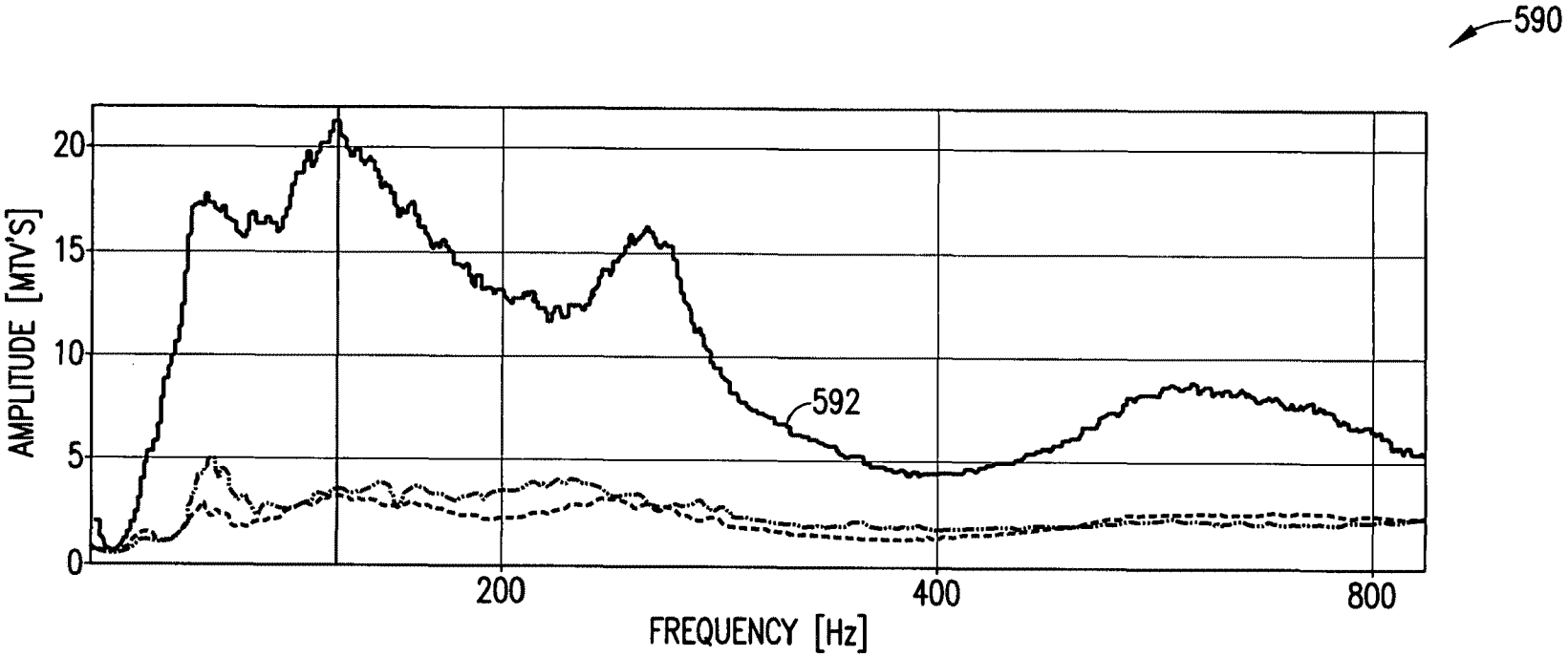
FIG. 16 is a graphical representation of laser vibro-meter measurements taken to detect vibrations caused by integrated hands-free devices.

Referring now to FIG. 16, back cover vibrations caused by integrated hands-free (IHF) performance is shown in graph 590. Graph 590 illustrates measurements taken using a three-dimensional laser vibro-meter. Line 592 represents the beginning of vibration of a polycarbonate cover due to a constant signal from an IHF speaker. Line 592 shows that not only does the speaker itself start to vibrate, but that the back cover also vibrates and may emit unwanted sound frequencies. Epoxy damping material may be used to suppress or at least reduce such emissions.

It should be noted in graph 590 that undamped polycarbonate covers may resonate when coupled to audio transducers. In the exemplary embodiments of the phones described herein, mechanical coupling between the audio transducers and the mechanical structures is even stronger as compared to structures employing only earpieces and THF speakers. Thus, metal covers may be preferable over plastic covers, but at higher frequencies the metal covers may start to vibrate. Polycarbonate covers, however, may resonate at frequencies at which the user's hand is sensitive to haptic feedback (e.g., below about 500 Hz).

Figure 17:
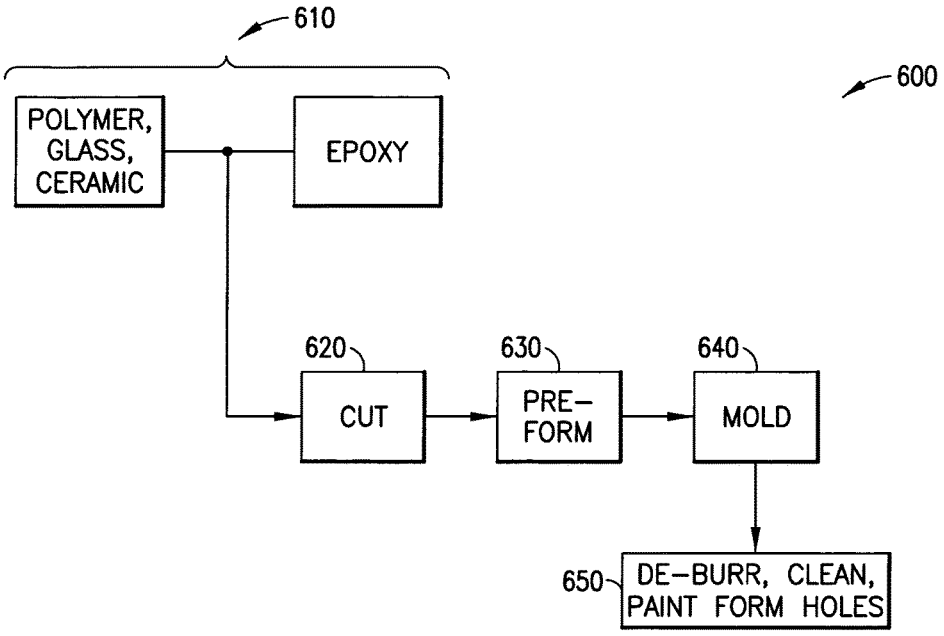
FIG. 17 is a flow of a method of forming a back cover for a mobile device.

Referring now to FIG. 17, a method for compression molding a back cover 125 comprising a composite material is designated generally by the reference number 600 and is hereinafter referred to as "method 600." In method 600, polymer, glass, and/or ceramic are combined with an epoxy material in a combination step 610. The combination is then cut, kitted (if necessary), and/or otherwise manipulated in a manipulation step 620, which is followed by a pre-form step 630. The pre-form composite is then molded in a molding step 640. The molded piece is then subjected to a series of steps 650 to de-burr, clean, paint, and form holes in the piece.

Figure 18:
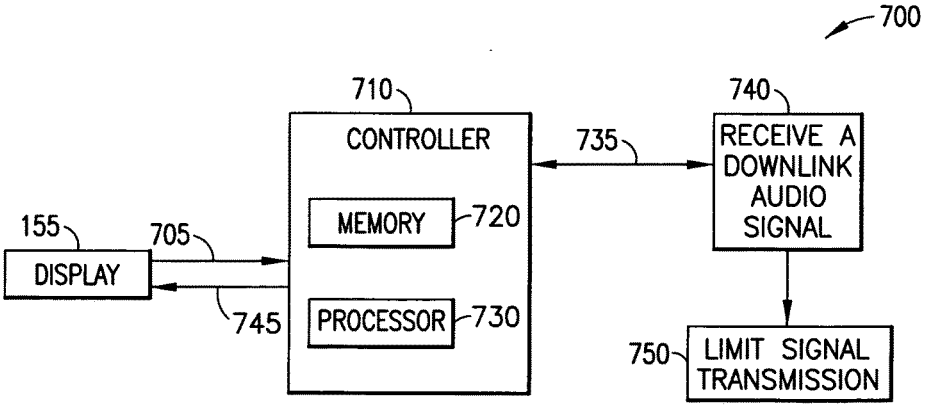
FIG. 18 is a flow of a computer-controlled method of receiving and attenuating a downlink audio signal.

Referring now to FIG. 18, one exemplary method of providing a downlink audio signal to the user while maintaining the privacy of the user is shown at 700. In the method 700, the user interacts with the phone 100 through the display 155 in an interaction step 705. The user interaction may comprise (but is not limited to) inputting data by responding to an "answer call" prompt. The interaction step 705 causes the operation of a controller 710 having a memory 720 and a processor 730 and provides communication (in a communication step 735) with a means for receiving a downlink audio signal in a downlink audio signal receiving step 740. The downlink audio signal is processed in the controller 710 and provided in a signal receiving step 745 back through the display 155 to the user. The downlink audio signal is limited in transmission from the phone 100 in a signal limiting step 750. This signal limiting step 750 may comprise the installation of epoxy material or any other vibration damping material (e.g., as the damping layer 140 on the back cover 125) on the phone 100.

In any of the foregoing exemplary embodiments, the construction of the chassis with the back cover provides an epoxy damping material to reduce sound radiation from an audio display device (such as a phone or other electronic device). The epoxy damping material may improve privacy leakage in such devices. Damping tape and foam may additionally reduce the vibration, which may reduce the emission of audio signals from the back cover. Employing an adhesive to couple the battery to the chassis, in conjunction with a damping tape or foam, may further facilitate the reduction of vibration, thereby reducing the emission of audio signals from the back cover. Furthermore, the use of such epoxy damping material may improve integrated hands-free performance as well as reduce the distortion level.

Any of the foregoing exemplary embodiments may be implemented in software, hardware, application logic, or a combination of software, hardware, and application logic. The software, application logic, and/or hardware may reside in the phone 100 (or other device). If desired, all or part of the software, application logic, and/or hardware may reside at any other suitable location. In an example embodiment, the application logic, software, or an instruction set is maintained on any one of various conventional computer-readable media. A "computer-readable medium" may be any media or means that can contain, store, communicate, propagate, or transport instructions for use by or in connection with an instruction execution system, apparatus, or device, such as a computer. A computer-readable medium may comprise a computer-readable storage medium that may be any media or means that can contain or store the instructions for use by or in connection with an instruction execution system, apparatus, or device, such as a computer.

In one exemplary embodiment, an apparatus comprises a movable section for sound generation; at least one actuator configured to actuate the movable section, the actuator being in communication with electronic circuitry and configured to generate an acoustic signal substantially from the movable section when the at least one actuator is driven by an audio signal; and a back cover (directly or indirectly) coupled to the movable section and configured to limit the generation of sound from the back cover by attenuating vibrations that are caused when the movable section is actuated by the at least one actuator. The movable section and the at least one actuator define a panel speaker.

The apparatus may further comprise a damping layer on an inner surface of the back cover, the damping layer comprising an epoxy material, which may comprise an elastomer substrate and an epoxide. The epoxy material may be adhered to the back cover using an epoxy adhesive. The apparatus may further comprise a first portion configured to carry one or more components of the apparatus, and at least one wall extending between two or more sides of the first portion, wherein the first portion comprises a chassis having rabbeted edges at a back face of the chassis, the rabbeted edges being configured to receive edges of the back cover. The apparatus may further comprise a lossy tape between the rabbeted edges of the chassis and the edges of the back cover. The back cover may comprise a polycarbonate, a polycarbonate and an elastomer material, and/or one or more of polycarbonate, glass, ceramic, and metal. The first portion may be fabricated from one or more of aluminum, aluminum alloy, stainless steel, magnesium, magnesium alloy, titanium, titanium alloy, and ceramic. The at least one wall may comprise a stiffening rib. A gap may be defined between the at least one stiffening rib and an inner surface of the back cover. A flexible suspension may be positioned between peripheral edges of the movable section and the back cover. An echo cancellation tape may be positioned on at least one portion of the apparatus for one or more of reducing sound waves within the apparatus and reducing sound waves from the back cover. An electronic device may comprise the apparatus, the electronic device comprising a phone, a camera, a video camera, a gaming unit, a navigation unit, or a tablet.

In another exemplary embodiment, a method comprises inputting data into an electronic device having a first portion and a second portion; causing the operation of a controller having a memory and a processor; communicating with a means for receiving a downlink audio signal; and providing the downlink audio signal through the first portion and limiting transmission of the downlink audio signal through the second portion by attenuating vibrations from the audio signal. Limiting transmission of the downlink audio signal through the second portion may comprise directing the downlink audio signal into a damping layer on the second portion.

In another exemplary aspect, a non-transitory computer readable storage medium comprises one or more sequences of one or more instructions which, when executed by one or more processors of an apparatus, cause the apparatus to at least: communicate with a means for receiving a downlink audio signal; and provide the downlink audio signal through the first portion and limiting transmission of the downlink audio signal through the second portion by attenuating vibrations from the audio signal.

It should be understood that the foregoing description is only illustrative. Various alternatives and modifications can be devised by those skilled in the art. For example, features recited in the various dependent claims could be combined with each other in any suitable combination(s). In addition, features from different embodiments described above could be selectively combined into a new embodiment. Accordingly, the description is intended to embrace all such alternatives, modifications, and variances which fall within the scope of the appended claims.

What is claimed is:

1. An apparatus, comprising:

a movable section for sound generation;

a chassis coupled to the movable section, the chassis comprising at least one rib extending between two or more sides of the chassis, the at least one rib configured to stiffen the chassis;

at least one actuator configured to actuate the movable section, the at least one actuator being in communication with electronic circuitry and configured to generate sound waves substantially from the movable section when the at least one actuator is driven by an audio signal such that the sound waves transmitted from the movable section cause a wide band sound output based at least in part on the at least one rib;

a back cover coupled to the movable section, a damping layer on an inner surface of the back cover, and a flexible suspension positioned between peripheral edges of the movable section and the back cover, the back cover being configured to receive reduced mechanical vibrations and the sound waves transmitted from the movable section and through the flexible suspension, the damping layer being configured to limit the generation of sound from the back cover by attenuating vibrations and the sound waves that are caused when the movable section is actuated by the at least one actuator; and wherein the movable section and the at least one actuator form a speaker such that the movable section vibrates upon actuation.

2. The apparatus of claim 1, wherein the damping layer comprises an epoxy material.

3. The apparatus of claim 2, wherein the epoxy material comprises an elastomer substrate and an epoxide.

4. The apparatus of claim 2, wherein the epoxy material is adhered to the back cover using an epoxy adhesive.

5. The apparatus of claim 1, wherein the chassis is configured to carry one or more components of the apparatus, and at least one wall extending between two or more sides of the chassis, wherein the chassis has rabbeted edges at a back face of the chassis, the rabbeted edges being configured to receive edges of the back cover.

6. The apparatus of claim 5, further comprising a tape between the rabbeted edges of the chassis and the edges of the back cover.

7. The apparatus of claim 1, wherein the back cover comprises a polycarbonate.

8. The apparatus of claim 1, wherein the back cover comprises a polycarbonate and an elastomer material.

9. The apparatus of claim 1, wherein the back cover comprises one or more of polycarbonate, glass, ceramic, and metal.

10. The apparatus of claim 5, wherein the chassis is fabricated from one or more of aluminum, aluminum alloy, stainless steel, magnesium, magnesium alloy, titanium, titanium alloy, and ceramic.

11. The apparatus of claim 5, wherein a gap is formed between the at least one rib and an inner surface of the back cover.

12. The apparatus of claim 1, further comprising a tape positioned on at least one portion of the apparatus for one or more of reducing the sound waves within the apparatus and reducing the sound waves from the back cover.

13. An electronic device comprising the apparatus of claim 1.

14. The electronic device of claim 13, wherein the electronic device comprises a phone, a camera, a video camera, a gaming unit, a navigation unit, or a tablet.

15. A method, comprising:

inputting data into an apparatus comprising a movable section, a chassis coupled to the movable section and comprising at least one rib extending between two or more sides of the chassis, the at least one rib configured to stiffen the chassis and to cause a wide band sound output based at least in part on the at least one rib, the movable section being coupled to an actuator to form a speaker such that the movable section vibrates upon actuation, and further comprising a back cover coupled to the movable section, a damping layer on an inner surface of the back cover, and a flexible suspension positioned between peripheral edges of the movable section and the back cover, the back cover being configured to receive reduced mechanical vibrations and sound waves transmitted from the movable section and through the flexible suspension;

causing the operation of a controller having a memory and a processor;

receiving a downlink audio signal into the apparatus; and limiting generation of the sound waves based on the received downlink audio signal through the back cover and the damping layer by attenuating vibrations that are caused when the movable section is actuated by the actuator.

16. The method of claim 15, wherein limiting generation of the sound waves through the back cover comprises directing the downlink audio signal into a damping layer on the back cover.

17. A non-transitory computer readable storage medium, comprising one or more sequences of one or more instructions which, when executed by one or more processors of an apparatus, causes the apparatus to at least:

receive a downlink audio signal into the apparatus; and limit generation of sound waves based on the received downlink audio signal from the apparatus by attenuating vibrations from a back cover and a damping layer of the apparatus, the back cover being configured to receive reduced mechanical vibrations and the sound waves transmitted from a movable section coupled to a chassis, the chassis comprising at least one rib extending between two or more sides of the chassis, the at least one rib configured to stiffen the chassis and to cause a wide band sound output based at least in part on the at least one rib such that the sound waves are transmitted through a flexible section to the back cover.

18. The method of claim 15, wherein inputting data into an apparatus comprises responding to a prompt from the apparatus.

* * * * *